United States Patent [19]

Reissmüller

[11] 3,938,967

[45] Feb. 17, 1976

[54] DEVICE FOR POST-ATOMIZATION FOR COMBUSTION ENGINES USING A COMPRESSED MIXTURE AND AN EXTERNAL IGNITION

[76] Inventor: Anton Reissmüller, Failenschmidstrasse 28, D-7320 Goppingen-Jebenhausen, Germany

[22] Filed: Mar. 31, 1975

[21] Appl. No.: 563,635

[30] Foreign Application Priority Data

Mar. 29, 1974 France ..... 74.11406

[52] U.S. Cl. ..... 48/180 R; 48/180 B; 48/180 C; 48/180 M; 123/131; 123/141; 138/37; 261/79 R

[51] Int. Cl.[2] ..... B01F 3/02

[58] Field of Search ..... 48/180 R, 180 C, 180 M, 48/180 B; 261/79 R; 123/141, 131; 138/37

[56] References Cited

UNITED STATES PATENTS

| | | | |
|---|---|---|---|
| 1,636,187 | 7/1927 | Kessel | 261/79 R |
| 2,134,021 | 10/1938 | Barnes | 48/180 R |
| 2,685,504 | 8/1954 | Ulbing | 48/180 R |
| 2,786,744 | 3/1957 | Beck, Jr. | 48/180 R |

FOREIGN PATENTS OR APPLICATIONS

| | | | |
|---|---|---|---|
| 239,817 | 9/1925 | United Kingdom | 261/79 R |

*Primary Examiner*—Robert L. Lindsay, Jr.
*Assistant Examiner*—George C. Yeung
*Attorney, Agent, or Firm*—Herbert E. Kidder

[57] ABSTRACT

A device for use between the carburetor and intake manifold of an internal combustion engine, to produce a highly turbulent flow condition in fuel/air mixture, thereby causing better mixing and homogenization of the fuel and air, and breakup of the minute fuel droplets into even finer droplets. The device has a narrow outer conical ring contiguous to the inner surface of the manifold throat, with sides converging in the downstream direction. Helically twisted fins extend downwardly and radially inward from the outer ring, and are attached to a smaller-diameter inner conical ring located in the center of the manifold throat. Adjacent the inner ring, the fins are enlarged to form blades that are curved to impart a gyratory movement to part of the fuel/air mixture, while part of the mixture passes straight through the device without being given a gyratory motion. The gyrating and non-gyrating portions of fuel/air mixture intermix below the device to form a highly turbulent flow that breaks up the liquid droplets of fuel and produces intimate mixing and homogenization of the fuel and air.

3 Claims, 3 Drawing Figures

DEVICE FOR POST-ATOMIZATION FOR COMBUSTION ENGINES USING A COMPRESSED MIXTURE AND AN EXTERNAL IGNITION

The present invention pertains to a device for post-atomization of the fuel/air mixture in the intake manifold of an internal combustion engine. The term "post-atomization" as used herein may be defined as a further breaking up of the fuel droplets entrained in the air leaving the carburetor, together with an intimate mixing and homogenization of the fuel/air mixture before it is delivered to the cylinders. This post-atomization of the fuel/air mixture is produced by a device that is mounted by means of a flange between the carburetor and intake manifold of the engine. The device comprises a plurality of blades of slight thickness directing the flow of the combustion mixture. These blades, mounted on the flange, are arranged in the throat of the intake manifold and are directed towards a circular opening situated below the flange. The said blades are of such a shape that they accelerate the inducted fuel-/air mixture and impart of gyratory movement thereto.

Devices of this kind are known from U.S. Pat. No. 1,689,446. Likewise are known devices directing the flow of combustion mixture towards a nozzle by imparting thereto a gyratory movement, as in German Gebrauchsmuster Registration No. 7.042.641. U.S. Pat. No. 1,396,054 also describes a similar device. All of these aforementioned devices, however, have the objectionable feature of being mounted in the throat of the intake manifold near the butterfly valve. Due to this fact, they contribute to loss of pressure head of the intake system. Devices such as those described in German Gebrauchmuster No. 7.042.641 have an even more serious disadvantage in that they impart a gyratory movement to the fuel/air mixture before its entry into the nozzle. This gyratory movement however cancels itself during the passage of the mixture through the nozzle. Due to this fact, this kind of device contributes nothing to the homogenization of the mixture and ipso facto becomes of no value. The invention described herein is based on the technique used in the aforementioned devices while eliminating their known disadvantages.

The object of the present invention is to provide a device that improves upon the homogeneity of the fuel/air mixture delivered by the carburetor to the cylinders of an internal combustion engine. This problem has been solved according to the invention by a device 10 that directs the flow of the mixture into a conical ring 4 which is stamped out of a flange, and onto which there are mounted fins 5*a* terminating in the shape of blades 5*b*, each of which is joined tangentially to the nozzle 6 and extends radially with respect to the wall of the intake manifold.

The preferred embodiment of the invention is described below, with reference to the accompanying drawings.

Figure 1:
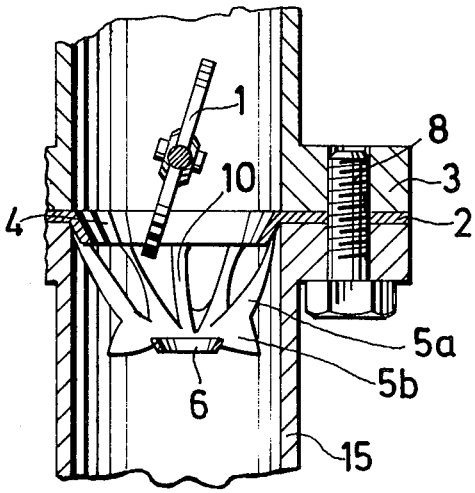
FIG. 1 shows a longitudinal cross-section through the device of the invention, showing the same clamped between the carburetor and intake manifold.

The device of the invention is designated by the reference numeral 10 and includes a flange 2 that is clamped between the base of the carburetor 3 and the connecting flange of the intake manifold 15, by means of connecting screws 8. A narrow rim of the flange 2 projects into the throat 16 of the intake manifold, and is bent downwardly to form a conical ring 4 that is contiguous to the inner surface of the manifold throat. Attached to the outer side of the conical ring 4 are several fins 5*a* which are arranged in generally conical configuration, extending downwardly and radially inward with respect to the manifold throat. The fins 5*a* extend downstream, and at their lower ends are enlarged to form helically curved blades 5*b*, directed radially towards the wall of the intake manifold. These blades 5*b* are attached at their inner ends to a central, downwardly converging, conical ring 6 which forms a nozzle for the fuel/air mixture, the junction of the blades to the ring being somewhat tangential to the central opening of the ring. The direction of flow of the inducted fuel/air mixture is shown by arrows 7. The amount of downstream-extension of the fins 5*a* is determined by the shape of the part of the intake manifold joining the carburetor, and one reason for such downstream-extension of the fins is to provide clearance for the bottom edge of the butterfly valve 1 when the latter opens. The butterfly valve 1 of the carburetor is mounted on a butterfly/shaft 11.

Figure 2:
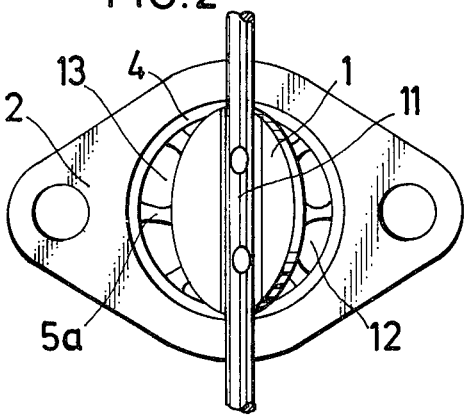
FIG. 2 shows a plan view of the device, looking down into the throat of the manifold.

Reference numeral 12 (see Fig. 2) indicates the cross-sectional area of the segment of the intake manifold which frees the half of the butterfly valve pivoting upstream. The reference numeral 13 indicates the cross-sectional area of the corresponding segment, which restricts the corresponding half of the butterfly valve pivoting downstream.

The fins 5*a* are attached to the back side of the smooth cone 4 in order to avoid needlessly increasing resistance to the flow of the fuel/air mixture in the pivoting range of the butterfly. These fins are constructed in such a manner that the transverse axis of each is directed radially. Due to this fact, it is only the thickness of the fins which acts as resistance to the flow of the mixture. For this reason, the width dimension of the fins 5*a* is essentially dictated by the resistance requirements. Due to this fact, fins 5*a* contribute in a less important manner to the gyratory movement of the inducted mixture. The blades 5*b* are disposed at the level of the section of the central nozzle 6.

Figure 3:
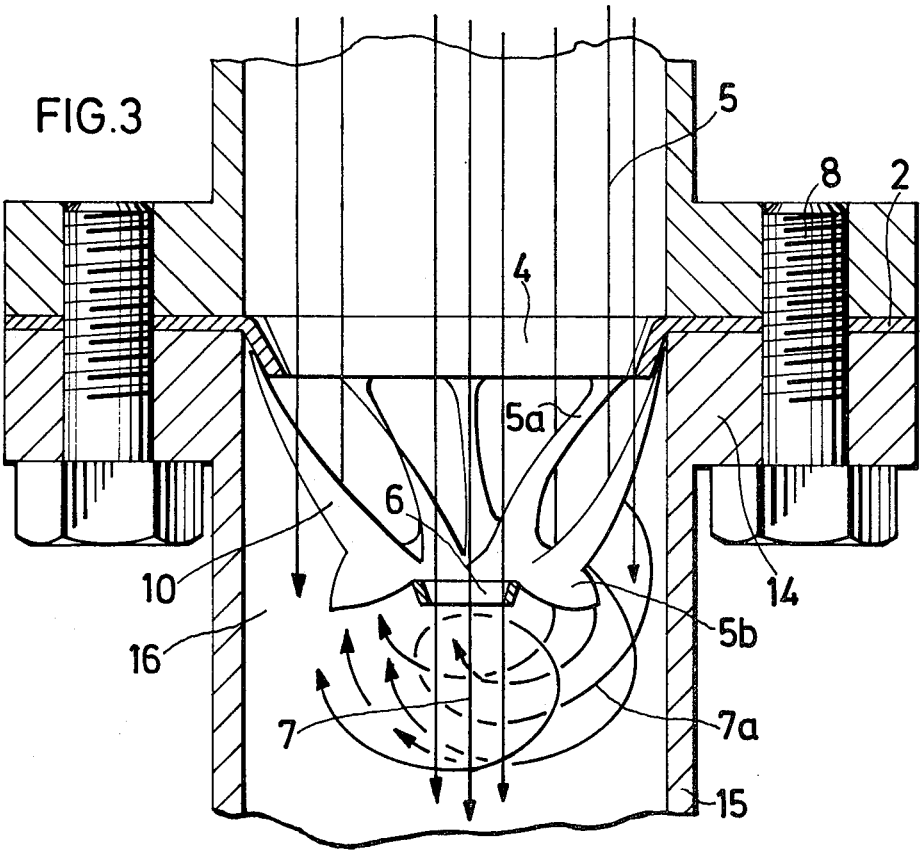
FIG. 3 is an enlarged cross-sectional view similar to FIG. 1, with arrows indicating the direction of flow of the fuel/air mixture.

As shown in FIG. 3, the fuel/air mixture flowing from the carburetor down into the intake manifold has a straight-line flow, as shown by the arrows 5. That portion of the mixture at the very center of the manifold throat passes vertically down through the open center of the nozzle 6, and its flow lines continue in a more-or-less straight line. However, that portion of the mixture which passes through the blades 5*b* has a gyratory motion imparted thereto by the blades, as shown by the arrows 7*a*. Below the device 10, the gyrating flow 7*a* mixes with the straight-through flow 7, producing a highly turbulent churning action, which results in breaking up the droplets of liquid fuel into still smaller droplets, while at the same time intimately mixing ahd homogenizing the mixture.

The nozzle 6 can equally well be considered as a diaphragm or as a venturi pipe. In the wall of the divergent part of a venturi pipe, facing downstream of the movement of the mixture, one can also provide openings serving as the entrance for mixture not passing through the venturi pipe itself.

A dispersion of the mixture is thus avoided and the waves of heat coming from the pre-heating chambers of the induction pipes remain without effect on the mixture thanks to the device directing the flow of the mixture.

While I have shown and described in considerable detail what I believe to be the preferred form of my invention, it will be understood by those skilled in the art that the invention is not limited to such details, but may take other forms within the scope of the following claims.

What I claim is:

1. A device for post-atomization of fuel/air mixture delivered by a carburetor through an intake manifold to the cylinder of an internal combustion engine, said device including a flange mounted between the carburetor and the intake manifold, said flange forming a conical ring contiguous with the inner surface of the manifold throat, a plurality of fins attached at their outer ends to said conical ring and extending radially inward toward the center of the manifold throat, and in the downstream direction with respect to the flow of the fuel/air mixture, a circular nozzle at the center of the manifold throat and below said conical ring, said nozzle having a central opening, said fins at their inner ends being enlarged and curved to form blades that join said nozzle tangentially with respect to said opening, and said blades for the most part extending radially outward toward the wall of the intake manifold.

2. A device as in claim 1, characterized in that the conical ring is stamped in the flange.

3. A device as in claim 1, characterized in that the outer ends of the fins are mounted on the rear face of the conical ring.

* * * * *